United States Patent [19]

Fortuna

[11] 4,357,510

[45] Nov. 2, 1982

[54] SWITCH DEVICE FOR USE ON CIRCUIT BOARD

[75] Inventor: Jon A. Fortuna, Mechanicsburg, Pa.

[73] Assignee: AMP Incorporated, Harrisburg, Pa.

[21] Appl. No.: 238,885

[22] Filed: Feb. 27, 1981

[51] Int. Cl.[3] ..... H01H 1/26; H01H 1/28

[52] U.S. Cl. ..... 200/283; 200/284; 200/245; 200/6 C

[58] Field of Search ..... 200/284, 271, 285, 283, 200/245, 6 BB, 6 C

[56] References Cited

U.S. PATENT DOCUMENTS

| | | | |
|---|---|---|---|
| 218,853 | 8/1879 | Bobb et al. . | |
| 3,911,383 | 10/1975 | Tabei et al. | 200/283 |
| 4,144,430 | 3/1979 | Coldren et al. | 200/245 |
| 4,152,556 | 5/1979 | Schadow | 200/5 B |

*Primary Examiner*—Willis Little

*Attorney, Agent, or Firm*—Frederick W. Raring

[57] ABSTRACT

One-piece stamped and formed switch device which is intended for mounting on a circuit board comprises an elongated flat base having mounting tabs or posts extending from its ends. A flange extends from one of the ends in the opposite direction from the direction of the mounting tabs and provides a fixed contact surface. A cantilever spring is integral with the base portion at the opposite end and extends alongside the base portion past the flange. In use, the switch device is mounted on the circuit board by inserting the mounting tabs through holes in the circuit board. Thereafter, an intermediate portion of the base is removed by shearing so that the remaining portions are electrically isolated from each other and the spring arm can be engaged with the flange to close a circuit between the conductors on the underside of the circuit board.

9 Claims, 6 Drawing Figures

Fig. 4
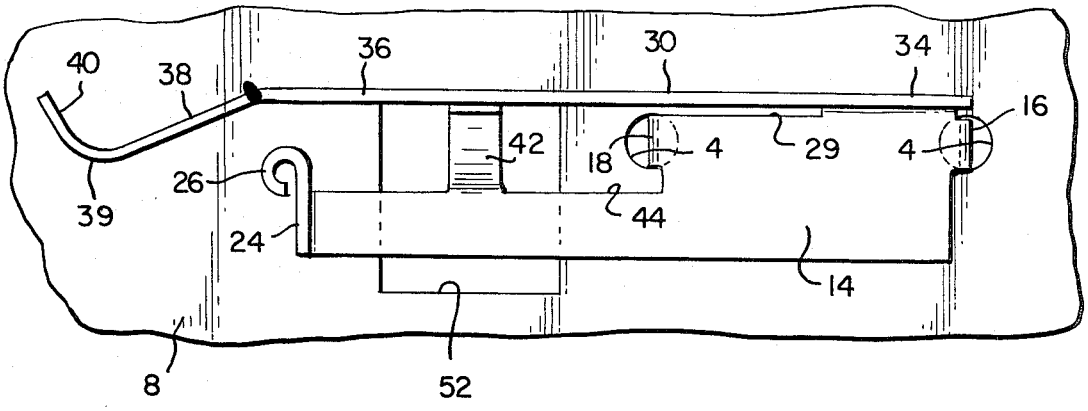
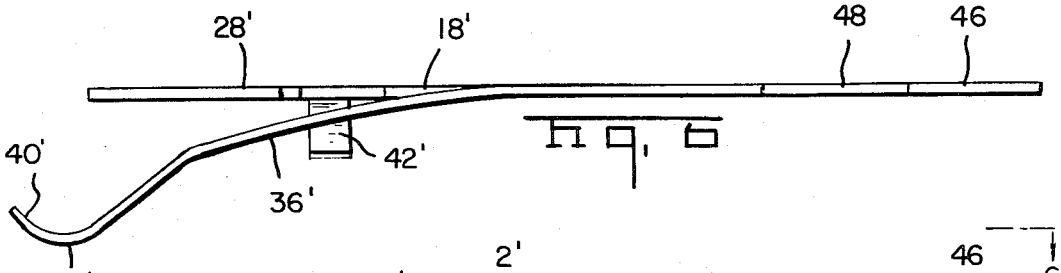
Fig. 6
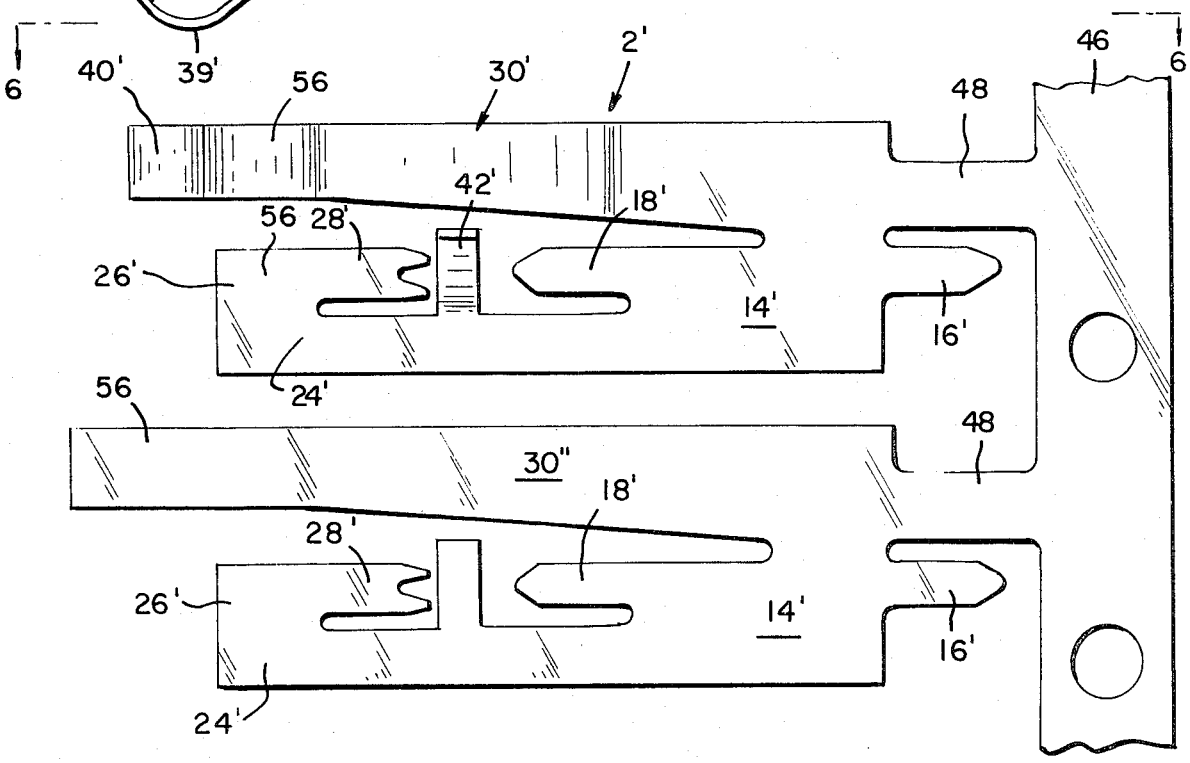
Fig. 7

SWITCH DEVICE FOR USE ON CIRCUIT BOARD

FIELD OF THE INVENTION

This invention relates to electrical switches intended for mounting on a circuit board to provide circuit paths between conductors on the circuit board.

BACKGROUND OF THE INVENTION

It is frequently required in the manufacture of electronic equipment to provide switch devices on circuit boards between conductors on one surface of the circuit board. Usually, such devices comprise two or more separate metal parts such as a spring arm and a contact post which must be individually assembled to the circuit board. U.S. Pat. No. 4,144,430 shows one type of stamped and formed switch device comprising a separate cantilever spring which is mounted on the circuit board in a manner such that its free end will engage a terminal post also mounted on the circuit board.

It would be desirable to produce sheet metal switch devices as one-piece parts rather than as two-piece parts which could be directly inserted into circuit board holes so that the entire switch would be produced as a result of the single insertion operation. The present invention is directed to the achievement of such a one-piece switch device in strip form so that individual switch devices can be assembled to circuit boards by suitable automatic or semi-automatic insertion machinery.

A preferred embodiment of the invention comprises a switch which is normally closed after application to the circuit board and which has an elongated flat base having mounting tab and mounting post means extending from the ends thereof. An integral flange is provided on an end of the base and extends in the opposite direction from the direction of the mounting tabs. A spring arm is integral with the base at the remaining end, the opposite end from the end on which the flange is located, and extends beside the base portion past the flange. This spring arm has a resilient bias towards the flange but prior to insertion of the switch device has been mounted on the circuit board and the mounting tabs or posts have been soldered to the circuit board conductors, an intermediate portion of the base is removed so that the flange is electrically isolated from the remaining portions of the base. The stop is also removed and the spring arm, under the influence of its pre-stressed condition, moves against the flange thereby to complete a circuit between the conductors to which the mounting posts are soldered. The spring arm can be flexed away from the flange when it is desired to interrupt the circuit.

BRIEF DESCRIPTION OF THE DRAWINGS

FIG. 3 is a view similar to FIG. 2 showing the appearance of the parts after soldering and after removal of intermediate portions of the base of the switch.

FIG. 4 is a plan view of the switch on the circuit board prior to soldering.

FIG. 5 is a plan view of a short section of a carrier strip having switch blanks integral therewith.

FIG. 6 is a view looking in the direction of the arrows 6—6 of FIG. 5.

DETAILED DESCRIPTION OF THE PREFERRED EMBODIMENT

Figure 1:
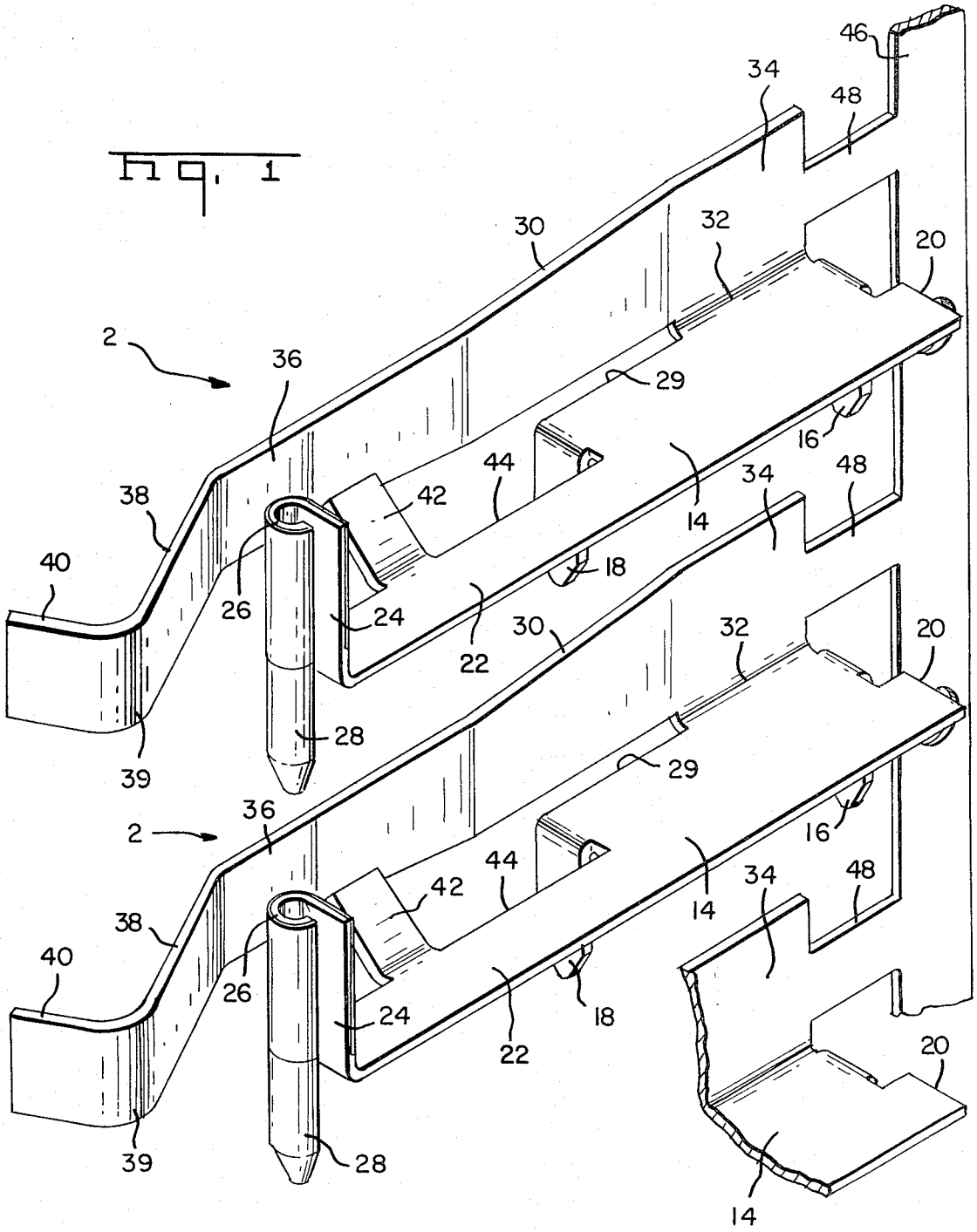
FIG. 1 is a perspective view of a short section of strip having switch devices in accordance with the invention integral therewith.

As shown in FIG. 3, a switch device 2 in accordance with the invention is intended for mounting in holes 4, 6 in a circuit board 8 having conductors 10, 12 on its underside. The switch device provides switching between these conductors, the disclosed form of the invention being a normally closed switch so that a circuit path will exist between the conductors until the switch is opened.

Prior to insertion into the holes 4, 6, the switch device 2 comprises a relatively elongated flat base portion 14 having a tab 16 extending downwardly from the first end 20 thereof and having an additional tab 18 extending downwardly from the base intermediate its ends. The left-hand portion as viewed in the drawing 22 of the base is of reduced width and has an upstanding flange 24 at its end. The flange 24 has a laterally extending ear portion which is rolled as shown at 26 to form a contact post on the upper surface of the circuit board. The rolled ear portion extends downwardly beneath the plane of the base 14 to provide a mounting post 28 which is soldered to the conductor 12 on the circuit board.

A cantilever spring arm 30 extends beside the left-hand edge 29 of the base portion and is integral at its fixed end 34 with the base portion as shown at 32. As will be explained below, the spring arm is formed when a flat spring blank is bent upwardly from the plane of the base portion 14.

The spring arm is of reduced width along its length and has a contact portion 36 which is opposed to the surface of the contact post 26. The spring arm extends obliquely towards and past the post from the contact portion as shown at 38 and is then bent as shown at 39 to provide a free end portion 40.

The spring arm 30 has a resilient bias urging it to move towards and against the surface of the contact post 26; however, in its as-manufactured form, the spring arm is maintained in spaced relationship to the contact post by means of a stop 42 which is integral with the edge 44 of the reduced width portion 22 of the base. This stop extends obliquely upwardly from the plane of the base and bears against the surface of the contact spring.

Switch devices in accordance with the invention are produced in continuous strip form, each switch device being connected to a carrier strip 46 by means of a connecting section 48 which extends from the right-hand edge of the spring arm at the fixed end thereof.

Figure 2:
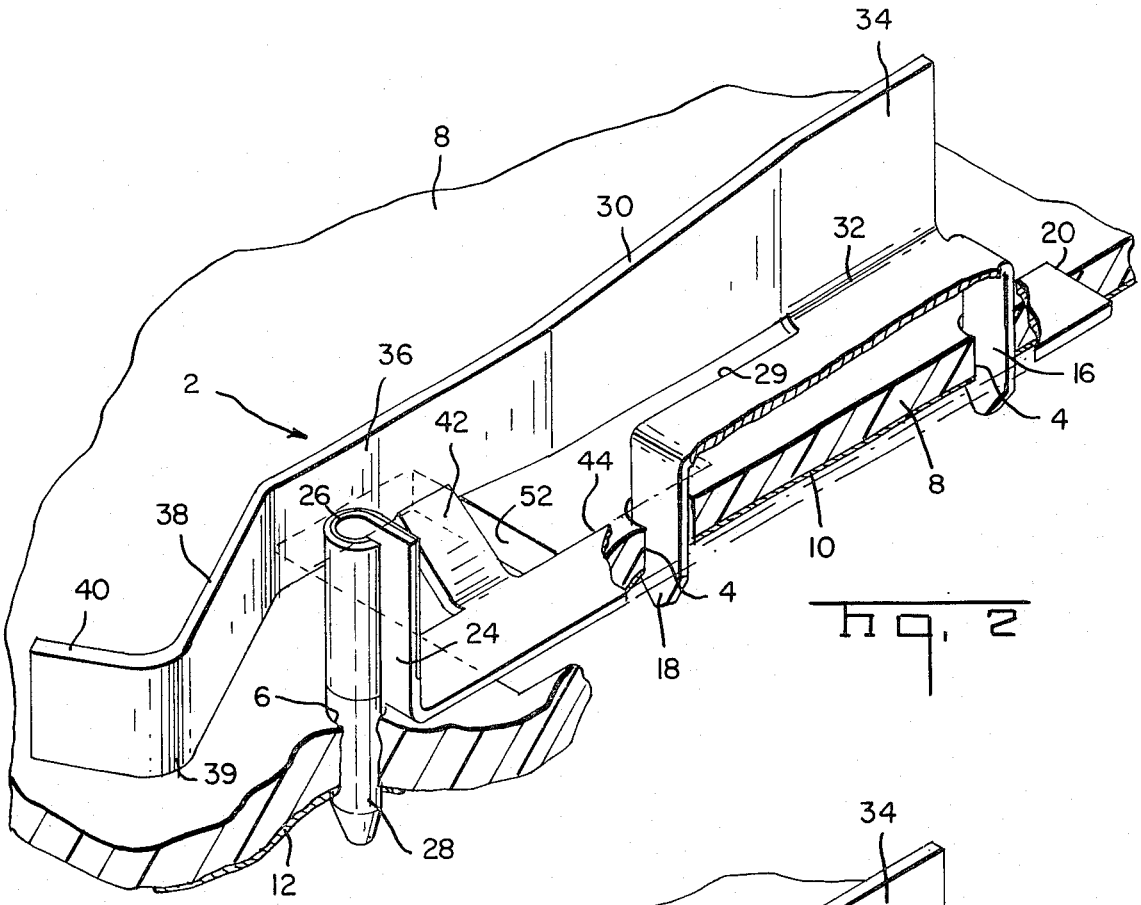
FIG. 2 is a perspective view showing a switch device mounted on a circuit board prior to soldering of the mounting post and tabs to the circuit board conductors.
Figure 7:
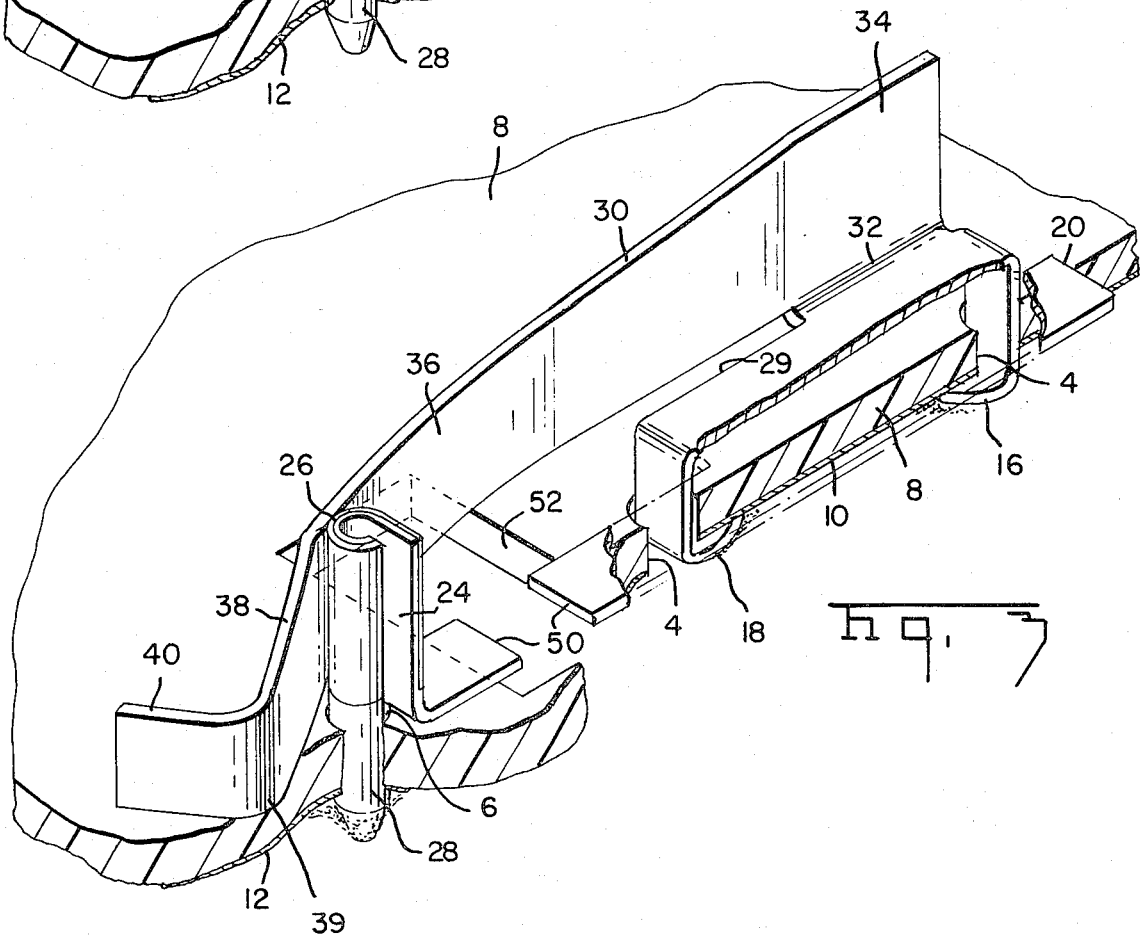

In use, an individual switch device is removed from the carrier strip and inserted into the holes 4, 6 of the circuit board as shown in FIGS. 2 and 4. The tabs 16, 18 are then clinched against the conductor 10 of the circuit board and the lower ends of these tabs and the lower end of the mounting post 6 are all soldered to the conductors. As shown in FIG. 4, the circuit board is provided with an enlarged hole 52 beneath an intermediate portion of the base 14 and beneath the stop 42. After soldering, an intermediate portion of the base, including the stop 42, is removed by shearing at shown at 50 and the spring arm 30 thereafter moves against the surface of the post 26. The spring arm can be disengaged from the post by simply flexing it away from the post. The flexing force can be applied against the end portion or the reverse bend 39 of the spring arm.

FIG. 5 shows a short section of a strip of blanks from which switch devices in accordance with the invention are formed. The parts of the blanks are identified with the same reference numerals, differentiated by prime marks, as were used above in the description of the formed switch devices. As is apparent from FIG. 5, contact metal such as gold can be plated in a narrow bank of the strip as shown at 56 and in the formed switch device of FIG. 1 the plated surfaces will be on the rolled contact post 26 and on the contact surface 36. The plating is applied to only one surface of the strip of FIG. 5 since the surface of the post and the contact surface 36 are both on the visible sides of the blanks of FIG. 5.

The pre-loading or pre-stressing of the cantilever spring arm 30 is achieved by imparting the profile shown in FIG. 6 to the portion 30' of the blank prior to bending the base portion from the plane of the blank to its position as shown in FIG. 1. The stop member 42' may be struck upwardly from the plane of the blank so that it will engage the spring arm 30'. When the spring arm 30' is formed as shown in FIG. 6, the end portion 40' is drawn inwardly as is apparent from a comparison of the lower blank in FIG. 5, which has an unformed or flat spring arm 30', with the upper blank.

If desired, normally open rather than normally closed switches can be produced in accordance with the invention. To produce a normally open switch, the switch arm is not formed as shown in FIG. 6 or is formed in another manner which will space the contact surface from the contact post 26 by the desired amount.

Switch devices in accordance with the invention can easily be inserted into circuit board holes by means of automatic or semi-automatic insertion machines. By virtue of the fact that two tabs 16, 18 are provided and these tabs are clinched against the underside of the circuit board after insertion, the holes 4 which receive the tabs can be relatively oversize. The hole 6 which receives the integral solder post 28 will be slightly oversize relative to the diameter of the solder post. The two tabs 16, 18 are precisely located relative to each other during manufacture since they are formed from the same section of the blank and are adjacent to each other.

What is claimed is:

1. A one-piece stamped and formed switch device which is intended for mounting in holes in a circuit board as a circuit board switch of the type comprising a fixed contact post and a cantilever spring arm which is engageable with said contact post, said switch device comprising:

an elongated flat base portion having spring arm mounting means extending therefrom at one end thereof, said spring arm mounting means extending substantially normally of said base portion in a first direction, a flange extending normally of said base portion at the other end thereof in a second direction which is the opposite direction from said first direction, said contact post being integral with said flange and extending beside said flange, said post projecting in said one direction past the plane of said base portion, and normally of the plane of said base portion, said cantilever spring arm being disposed beside said base portion in a plane which extends normally of the plane of said base portion, said spring arm having a fixed end which is integral with said base portion at said one end, said spring arm extending beside said base portion and past said flange whereby, upon insertion of said spring arm mounting means and said contact post into circuit board holes and soldering said mounting means and said post to conductors on the underside of said circuit board, and upon thereafter removing intermediate portions of said base, said contact post will be electrically isolated from said spring arm mounting means and said spring arm can flex against portions of said post thereby providing a switch on said circuit board for switching said two conductors.

2. A switch device as set forth in claim 1, said spring arm being resiliently biased towards said contact post, said switch device having a stop integral with said base portion and extending towards said spring arm, said stop maintaining said spring arm in spaced relationship from said contact post, said stop being removable along with said intermediate portions of said base portion whereby said spring arm will move against said post to provide a normally closed switch.

3. A one-piece stamped and formed switch device which is intended for mounting in holes in a circuit board as a noramlly closed circuit board switch, said switch device comprising:

an elongated flat base portion having spring arm mounting means extending therefrom at one end thereof, said spring arm mounting means extending substantially normally of said base portion in a first direction, a flange extending normally of said base portion at the other end thereof in a second direction which is the opposite direction from said first direction, said flange having an integral contact post extending beside said flange and projecting in said one direction past the plane of said base portion, a cantilever spring arm disposed beside said base portion in a plane which extends normally of the plane of said base portion, said spring arm having a fixed end which is integral with said base portion at said one end, said spring arm extending beside said base portion and past said flange, said spring arm having a resilient bias towards said flange, a stop extending from said one side edge of said base portion intermediate said ends, said stop being against said spring arm and restraining said spring arm against its resilient bias and thereby maintaining said spring arm in spaced relationship to said flange whereby, upon insertion of said spring arm mounting means and said contact post into circuit board holes, soldering said spring arm mounting means and said post to conductors on the underside of said circuit board, and thereafter removing intermediate portions of said base including said stop, said contact post will be electrically isolated from said spring arm mounting means and said spring arm will move against, and be resiliently biased against, portions of said flange thereby providing a normally closed switch on said circuit board.

4. A switch device as set forth in claim 3, said contact post comprising rolled portions of said flange.

5. A switch device as set forth in claim 4, portions of said spring arm and parts of said rolled portions constituting contact surfaces which are normally against each other when said switch device is installed on a circuit board, said contact surfaces having contact metal coated thereon.

6. A switch device as set forth in claim 5, said spring arm being of decreasing width along its length, said stop extending obliquely from said one side edge of said base towards said spring arm.

7. A switch device as set forth in claim 6, said spring arm mounting means comprising a first tab extending from said base at said one end and a second tab extending from said base intermediate the ends thereof.

8. A switch device as set forth in either of claims 3 or 7, said switch device being integral with a continuous carrier strip having a plurality of additional switch devices, which are identical to said switch device, internal therewith at spaced intervals along its length.

9. A switch device as set forth in claim 8, said switch device being connected to said carrier strip by means of a connecting section extending from said fixed end of said spring arm to said carrier strip.

* * * * *